US005109948A

United States Patent [19]

Sandstrom

[11] Patent Number: 5,109,948

[45] Date of Patent: May 5, 1992

[54] FREQUENCY CONTROLLED MOTOR DRIVEN LOW FREQUENCY SOUND GENERATOR

[75] Inventor: Roland Sandstrom, Stockholm, Sweden

[73] Assignee: Infrasonik AB, Stockholm, Sweden

[21] Appl. No.: 634,142

[22] PCT Filed: Jun. 27, 1989

[86] PCT No.: PCT/SE89/00366

§ 371 Date: Feb. 6, 1991

§ 102(e) Date: Feb. 6, 1991

[87] PCT Pub. No.: WO90/00095

PCT Pub. Date: Jan. 11, 1990

[30] Foreign Application Priority Data

Jun. 29, 1988 [SE] Sweden ..... 8802452

[51] Int. Cl.[5] ..... G10K 5/00

[52] U.S. Cl. ..... 181/142; 116/137 R; 116/140; 331/155

[58] Field of Search ..... 181/142, 119; 116/137 R, 140; 331/155

[56] References Cited

U.S. PATENT DOCUMENTS 1,173,708 2/1916 Chance ..... 116/137
4,307,964 12/1981 Dudgeon et al. ..... 366/127
4,359,962 11/1982 Olsson et al. ..... 116/137
4,801,897 1/1989 Flecken ..... 331/65

FOREIGN PATENT DOCUMENTS 3736890 5/1988 Fed. Rep. of Germany .
624659 8/1978 U.S.S.R. .
82/01328 4/1982 World Int. Prop. O. .
88/07894 4/1988 World Int. Prop. O. .

*Primary Examiner*—J. W. Eldred
*Attorney, Agent, or Firm*—Finnegan, Henderson, Farabow, Garrett & Dunner

[57] ABSTRACT

The invention relates to a frequency controlled motor driven low frequency sound generator. The low frequency sound generator consists of an open resonator (2) arranged as a sound emitter for generating standing gas-borne sound waves which produce a varying gas pressure inside the resonator, and a feeder unit (1) for a modulated supply of air pulses to the resonator. The feeder unit (1) comprises a motor driven piston (8) with an approximately sinusoidal volume velocity. The piston is mounted on a piston rod (7) which is connected to a flywheel (6). The flywheel, in its turn, is mounted on a shaft (5) which is driven by a motor (3). The motor speed and thereby the frequency of the piston is regulated by a special electronic control unit.

10 Claims, 4 Drawing Sheets

FREQUENCY CONTROLLED MOTOR DRIVEN LOW FREQUENCY SOUND GENERATOR

Figure 1:
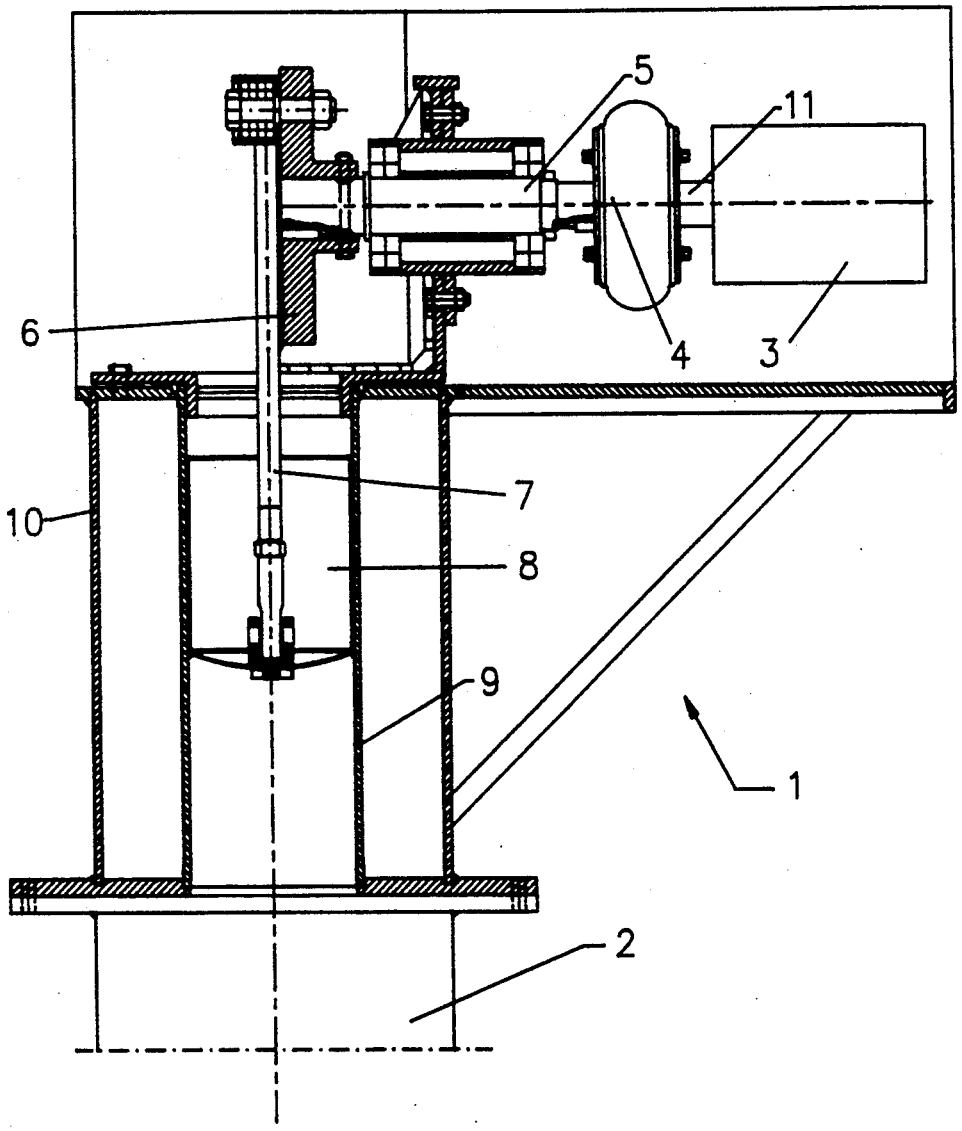

This invention relates to a frequency controlled, motor driven, low frequency sound generator.

A low frequency sound generator with a positive feedback system is described in SE, B, 446 157 (corresponding to EP, B1, 0 006 833). It consists of an open resonator arranged as a sound emitter for generating standing gas-borne sound waves, which produce a varying gas pressure in the resonator, and; a feeder unit with a pipe for supplying pressurized gas into the resonator and, a back and forth springing movable valve slide, the position of which remains unaffected by the pressurized gas. The valve slide regulates the gas flow from the pipe while supplying a modulated flow of pressurized gas into the resonator. The valve slide is constructed as a sleeve, which is axially displaceable inside or outside the pipe and controls an opening arranged in the pipe wall for the supply of pressurized gas from the source.

In SE, A, 8701461-9 (publication No. 457 240, corresponding to PCT/SE88/00172) a low frequency sound generator is described which is a further development of the above mentioned generator. The slide valve, in this case, is designed as a piston movable inside a pipe/-cylinder, said piston being arranged in order to regulate a connecting opening between an air surge tank and the inside of the cylinder at one of the end surfaces of the piston. The air surge tank surrounds the cylinder and the feeder unit and is also connected to the pressurized gas source. One end of the cylinder is open towards the interior of the resonator and the connecting opening may communicate with the interior of the resonator depending on the position of the piston.

The basic principle for the operation of both these low frequency sound generators is: when the sound pressure in the resonator is higher than the surrounding atmospheric pressure, the valve slide will move in such a direction as to free the opening, and then air having a higher pressure than the sound pressure will be forced into the resonator.

When the sound pressure in the resonator is lower than the surrounding atmospheric pressure, the valve slide will be forced to move in the opposite direction with the result that the opening is closed completely.

The above described low frequency sound generators are both air driven. In a feeder unit forming a part of the sound generator, working according to the above described principle, it is essential to supply a large volume of air through the opening during a very short period of time and with a minimum loss of pressure during the passage of the air into the resonator. The supplied pressurized gas has so far been generated by a blower, which is both space demanding and expensive as well as having the disadvantage of the supplied air being relatively hot. The purpose of the present invention is to generate sound pressure pulses in the resonator without the use of a blower.

The low frequency sound generators according to above mentioned documents have a positive feedback system which means that the movement of the valve slide and the subsequently generated pressure gas pulses are automatically adjusted to one of the natural frequencies of the air column inside the resonator. This way, adjustments can be made according to variations in the frequency depending on e.g. changes in the temperature. The apparatus, according to the present invention, is equipped with a control system which is normally used in such a way that a maximum sound pressure is obtained in the resonance unit in the same way as when using a positive feedback system as described above, but it can also be adjusted in such a way that a lower sound pressure may be obtained.

Figure 2:
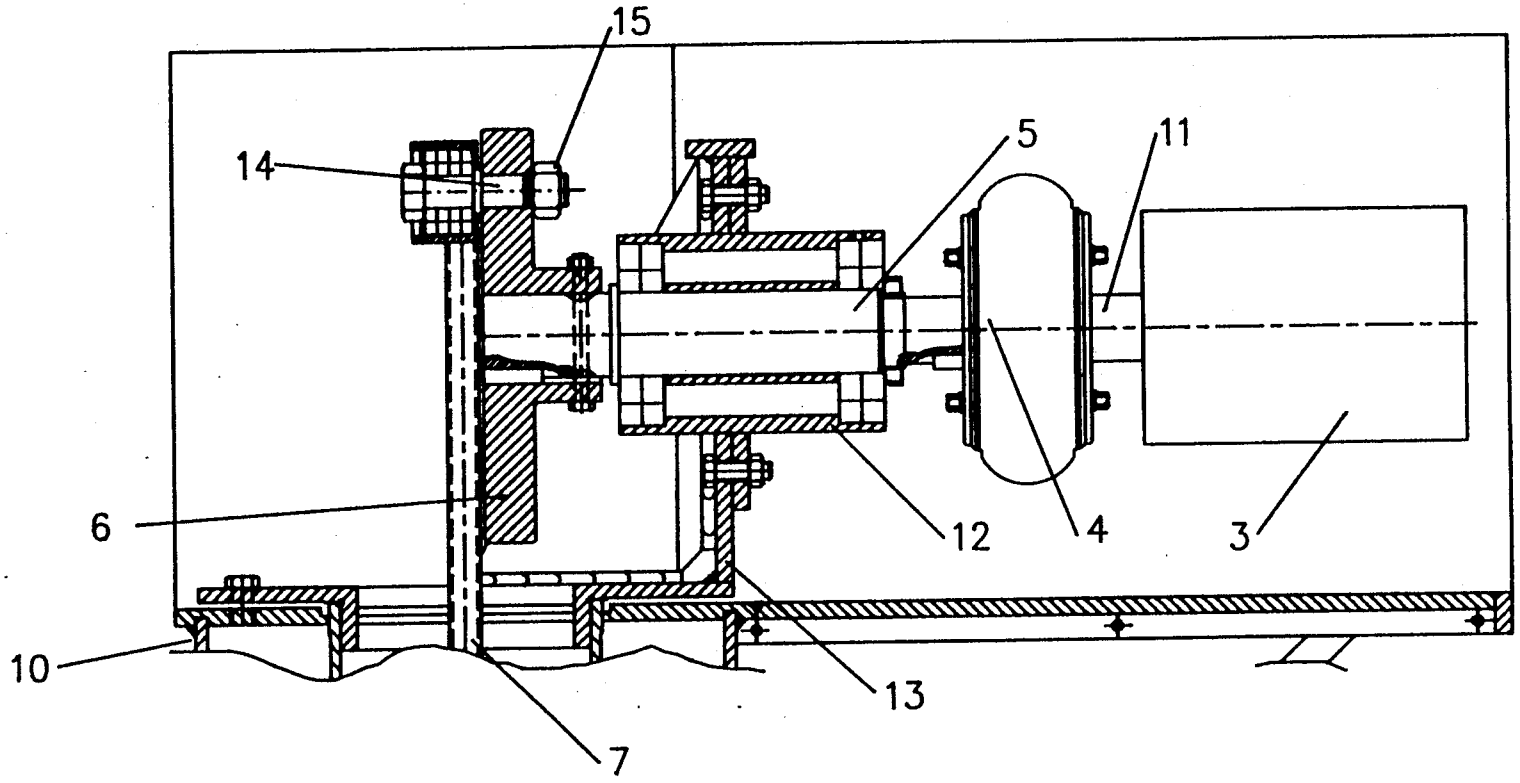
Figure 3:
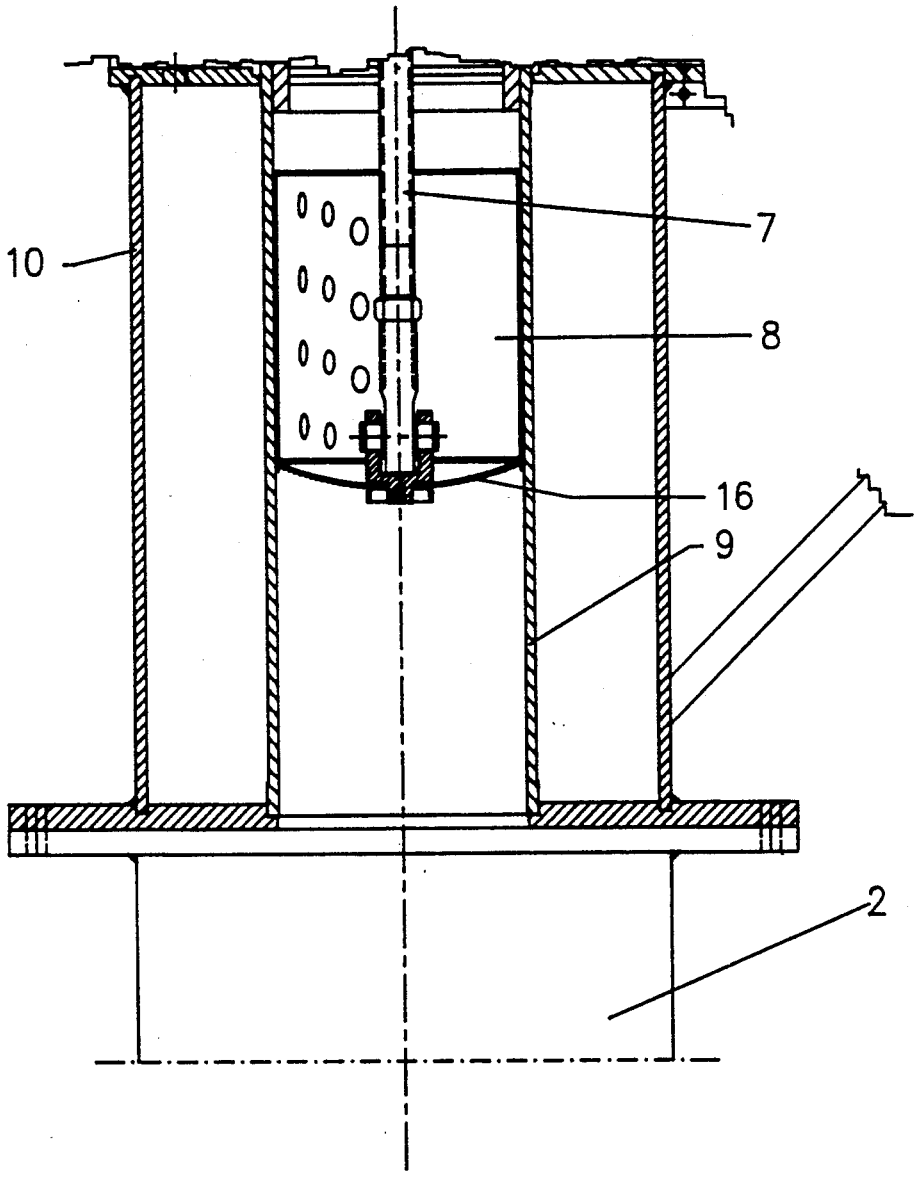
Figure 4:
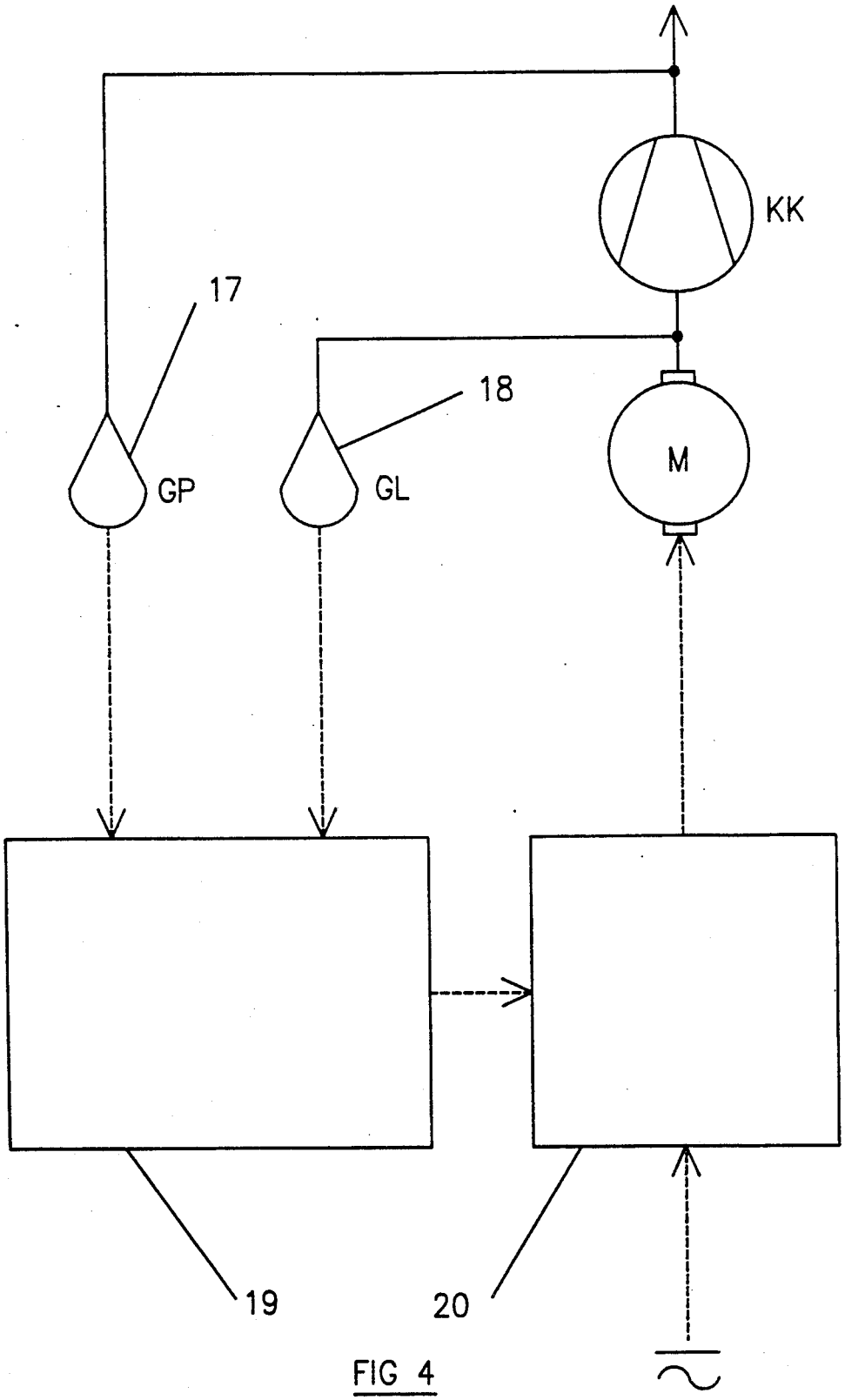

The invention, with examples of embodiments, will now be explained in detail with reference to enclosed drawings, in which:

FIG. 1 is a side view of the entire low frequency sound generator including resonator FIG. 2 shows the driving part of the feeder unit in enlargement FIG. 3 shows the air pulse generating part of the feeder unit in enlargement FIG. 4 shows a block diagram of the control system.

FIG. 1 shows a low frequency sound generator with a feeder unit 1 and a resonator 2, only fragmentarily shown in the figure. The resonator 2 preferably consists of a quarter wave resonance tube open at one end and closed at the other end, or a half wave resonance tube which is closed at both ends. In connection with the closed end of the resonator there is a feeder unit 1 installed. The main parts of the feeder unit consist of a driving part with a motor 3, whose drive shaft 11 via a clutch 4 is connected to a shaft 5. On the shaft 5 there is a flywheel 6 attached, which in its turn is equipped with a number of holes for optional mounting of a piston rod 7. The piston rod 7 is attached to a piston 8, which is movable inside a cylinder 9 surrounded by a cylinder block 10. The airpulse generating part of the construction consequently consists of the piston 8 and the cylinder 9. It is the reciprocating movement of the piston 8 and the resulting, approximately sinusoidal, volume velocity of the piston that generates air pulses at the closed end of the resonator 2.

FIG. 2 shows the driving part of the feeder unit with a motor 3, which is carried by a support fastened on to the cylinder block 10. The drive shaft of the motor 11 is connected via the coupling 4 to the shaft 5. The coupling 4 is e.g. of rubber or other flexible material in order to absorb any angle, axial and/or radial play that may occur between the drive shaft 11 of the motor 3 and the shaft 5. It also carries torque variations, which are caused partly by the inertia of the piston and partly by the sinusoidal load consisting of pressure variations in the resonance tube which have not already been eliminated by the flywheel. The shaft 5 is carried by a bearing housing 12 which in its turn is fastened, with a right angle bracket 13, to that end of the cylinder block 10 which is turned away from the resonance tube 2. The bearing housing 12 can e.g. be mounted on the bracket 13 with a bolted joint or it could be welded on to it. On the end of the shaft 5 which is turned away from the motor 3 there is a flywheel 6 detachable connected. This flywheel is, at different distances from its center hole, equipped with holes for optional, detachable connection of the piston rod 7. The piston rod is mounted with bearings on a screw 14, with which it is attached to the flywheel 6, and by means of the screw 14 being drawn through one of the holes in the flywheel 6 made for this purpose, the screw being fixed with the help of a locking nut 15.

FIG. 3 shows the cylinder 9 and the piston 8. The other end of the above mentioned piston rod 7 runs through the piston 8 and is attached to its top whose end surface 16 may be bellowing outwards. The piston 8 is movable back and forth with low friction inside the cylinder 9 due to the fact that there is a small radial play between the piston and the cylinder. Furthermore the piston may preferably be equipped with holes in order to, among other things, lessen its weight and thereby also the mentioned friction. The holes also contribute to an improved cooling of the piston. The cylinder is located in the cylinder block 10, said cylinder block being mounted in connection with the closed end of the resonator 2.

Through the reciprocating movement of the piston 8 and the approximately sinusoidal volume velocity of the piston, sinusoidal air pulses are generated and will propagate into the resonance tube 2. Through reflection of these air pulses there is a standing sound wave building up in the resonance tube, said sound wave having its maximum sound pressure where the feeder unit is located. This sound pressure works upon the end surface 16 of the piston and generates a force working on the piston equal to the sound pressure multiplied by the area of said end surface. In order to obtain as high a sound intensity as possible, it is desirable that the reciprocating movement of the piston, which is determined by the flywheel 6 and the shaft 5, takes place with a frequency that, as far as possible is the same frequency as a certain chosen frequency corresponding to one of the natural frequencies of the air column inside the resonance tube 2.

FIG. 4 shows the control system for controlling the flywheel and thereby the movement of the piston. The control system is based upon the utilization of the phase displacement between the sound pressure measured at the end of the resonance organ 2 which is turned towards the cylinder block 10, and the speed of the piston. Said sound pressure is measured preferably with at least one gas pressure transducer 17 and the phase of the piston speed is preferably measured with at least one level indicator 18 mounted in connection with the flywheel. The phase for the piston speed corresponds to the phase of the position of the piston with a 90° displacement. The measured values are compared by means of a signal comparator 19, which then will send a control signal influencing a speed regulation device 20 connected to the motor 3. The transducer as well as the signal comparator and speed regulation device are preferably electronic. Maximum interaction between the movement of the piston and the resonator is obtained when the frequency of the piston is chosen so that the mentioned phase deplacement is equal to nil. During possible fluctuations in the standing wave frequency, due to e.g. temperature variations, the frequency of the piston is automatically adjusted. Due to this arrangement, the piston may also be forcibly controlled by means of chosing to give the piston a somewhat different frequency than the one corresponding to the frequency of the standing sound wave. This can be done either completely manually, or automatically controlled by a predetermined factor, e.g. the temperature, or controlled through other electronic equipment such as a computer. It is also possible to use a design where the speed regulation device is controlled directly by the gas pressure transducer without any level indicator being used.

Evidently, also other kinds of designs may be used within the frame of the idea of the invention. E.g. it is possible to exchange the shaft 5, the flywheel 6 and the piston rod 7 with a more conventional arrangement including a crankshaft and connecting rod.

I claim:

1. Low frequency sound generator comprising a resonator; a feeder unit with a movable member for supplying of gas pulses to the resonator inside which said gas pulses generate a standing gas-borne sound wave; a variable speed motor drivingly connected to said feeder unit to achieve a gas pulse generating movement of said movable member, wherein a phase displacement occurs between the movement of said movable member and the sound pressure of the standing gas-borne sound wave; and control unit means for the registration of said phase displacement, said control unit means including a speed regulation device operatively connected to the motor to guide the phase displacement towards an adjustable set point value.

2. Low frequency sound generator according to claim 1, wherein said control unit comprises at least one pressure transducer which measures the sound pressure inside the resonator proximate the feeder unit.

3. Low frequency sound generator according to claim 2, wherein the control unit comprises at least one level indicator which measures the position of the movable member of the feeder unit to determine the phase of the gas pulses.

4. Low frequency sound generator according to claim 3, wherein the control unit comprises at least one signal comparator operatively connected to said speed regulation device and which registers and processes the phase displacement and the set point valve and provides a control signal to the speed regulation device.

5. Low frequency sound generator according to claim 4, wherein the pressure transducer, the signal comparator and the speed regulation device are electronic.

6. Low frequency sound generator according to claim 5, wherein the set point value of the phase displacement is chosen to achieve resonance in the resonator.

7. Low frequency sound generator according to any one of the claims 1-6, wherein said movable member comprises a piston, and wherein said feeder unit includes a cylinder in which said piston is disposed for reciprocating movement at a velocity which is approximately sinusoidal.

8. Low frequency sound generator according to claim 7, wherein said feeder unit further includes a piston rod, a flywheel, and a flywheel shaft, the piston being attached to said piston rod, said piston rod being detachable and variably mounted on said flywheel, and said flywheel being mounted on said shaft which is operatively connected to be driven by the motor.

9. Low frequency sound generator according to claim 8, wherein the level indicator measures the position of the piston and wherein the signal comparator registers and processes the phase displacement between the sound pressure and the position of the piston and provides a control signal to the speed regulation device.

10. Low frequency sound generator according to claim 9, wherein the level indicator measures the position of the flywheel, for measuring the position of the piston indirectly, and wherein the signal comparator registers and processes the phase displacement between the sound pressure and the in directly measured position of the flywheel and provides a control signal to the speed regulation device.

* * * * *